United States Patent [19]

Blanton, III et al.

[11] Patent Number: 5,074,837

[45] Date of Patent: Dec. 24, 1991

[54] APPARATUS AND METHODS FOR RESTACKING FANFOLDED CONTINUOUS FORM PAPER OUTPUT FROM A PRINTER

[75] Inventors: Harvey B. Blanton, III, Lyndhurst; Thomas P. Hale, Afton, both of Va.

[73] Assignee: Genicom Corporation, Waynesboro, Va.

[21] Appl. No.: 478,560

[22] Filed: Feb. 12, 1990

[51] Int. Cl.[5] ..... B65H 45/105; B65H 45/101; B65H 45/109

[52] U.S. Cl. ..... 493/412; 493/410; 493/448

[58] Field of Search ..... 493/409, 410, 411, 412, 493/413, 414, 415, 448, 451, 456

[56] References Cited

U.S. PATENT DOCUMENTS

| | | | |
|---|---|---|---|
| 540,250 | 6/1895 | Hall | 493/413 |
| 4,721,295 | 1/1988 | Hathaway | 493/412 |
| 4,770,402 | 9/1988 | Couturier | 493/410 |
| 4,846,454 | 7/1989 | Parkander | 493/412 |

*Primary Examiner*—William E. Terrell

*Attorney, Agent, or Firm*—Nixon & Vanderhye

[57] ABSTRACT

The paper stacker includes a pair of pivoted generally L-shaped elements disposed above a vertically movable paper tray. The elements pivotally depend such that their lower paper support legs are normally inclined and terminate at free edges in a roller. Upon upward movement of the tray and stacking initial sheets of fanfolded paper on the tray, the sheets engage the undersides of the elements to pivot the elements and, hence, the lower legs into generally horizontal positions whereby paper may be stacked on the horizonally disposed support legs of the elements. Upon reaching a predetermined stack height, the tray moves downwardly away from the elements, enabling the paper carried thereby to fall through the opening onto the tray. Upward movement of the tray then engages the underside of the elements to compress the paper stacked on the tray and, upon slight downward displacement of the tray, enable further stacking of paper on the elements whereby the cycle of stacking paper on the elements, releasing paper from the elements onto the tray and compressing the paper on the tray may be repeated.

20 Claims, 5 Drawing Sheets

APPARATUS AND METHODS FOR RESTACKING FANFOLDED CONTINUOUS FORM PAPER OUTPUT FROM A PRINTER

BACKGROUND AND SUMMARY OF THE INVENTION

The present invention relates to apparatus and methods for stacking paper, particularly fan-folded continuous forms exiting printers, in a reliable manner and which minimizes stacking failures.

Stacking fan-folded continuous forms, i.e., forms folded in a continuous Z configuration, has previously been accomplished by a variety of mechanisms. For example, certain mechanisms have utilized slipping puller rollers which pull the paper from the host printer, direct its travel through a guide throat, and feed the paper onto a vertically movable elevator tray. Typically, newly-fed paper is stacked directly on the top surface of the elevator tray. As the paper accumulates on the tray, each newly-fed fan-folded form is stacked and becomes the top of the accumulated stack. As the stack increases in height, the distance between the top of the stack to the exit area of the feed throat decreases. It has been recognized that this distance is critical for the stacking mechanism to function properly with respect to stacking fan-folded continuous forms and must be maintained within certain limits. This is conventionally accomplished by sensing the location of the top surface of the stack. When it reaches a predetermined height, the elevator tray is incrementally lowered to allow more paper to be fed on top of the previously accumulated paper. This cycle is successively repeated until there is no more paper to be stacked.

Stacking failures, however, occur with such mechanisms. For example, the top of the stack develops a U-shaped channel onto which newly-fed paper is directed. Two unique manifestations of such U-shaped channel may obtain. The first evolves as the stretched holes in the edges of tractor-fed forms prevent the sides of the forms from stacking as close to each other as the layers of the paper in the middle of the stack. A characteristic U-shaped channel forms along an axis perpendicular to the folds in the paper. The second manifestation develops as the bending resistance along the folds prevents the folded edges of the forms from stacking as close to each other as the middle portions of the forms. In this case, a U-shaped channel grows along an axis parallel to the folds in the paper. Both cases become more pronounced as the height of the accumulated paper stack increases. They also may occur in combination with one another. Additionally, the probability of stacking failure increases as the unevenness of the top of the stack increases.

According to the present invention, there is provided a unique paper stacking apparatus and method for stacking paper which minimizes stacking failures and maintains a relatively flat surface on which newly-fed forms are stacked by repeated compressions of the accumulated paper stack. Particularly, the stacking apparatus hereof includes a pair of opposed, generally L-shaped, elements or channels at the front and rear portions of the stacker and which elements extend lengthwise generally parallel to the folded edges of the paper to be stacked. Each element thus has a generally vertically extending guide and a generally horizontally extending support leg or surface. At the toe end of each support surface, a free-wheeling roller preferably spans the entire length of the element, the elements being disposed in facing relation to one another with a space or opening therebetween. The elements are pivotally carried by rods for swinging movement below the rods, the rods serving as the pivot axes for the elements. The rods are supported in movable slides which permit the distance between the elements to be adjusted to accommodate various form lengths. The elements have end plates with vertically extending slots at their upper ends for receiving the rods. Springs interconnect between the rods and end plates to bias the elements into lowermost positions. Additionally, the elements are configured to have centers of gravity such that the elements lie in an inclined position relative to one another, i.e., their support surfaces are inclined relative to one another. A paper support tray is mounted below the support elements and is movable vertically relative to the support elements.

To stack paper on the paper stacker hereof, the tray is lowered and several sheets of paper are fed and stacked on the tray in fan-folded configuration. The sheets are fed through the opening between the elements. The tray is then raised and the distance between the elements is adjusted by moving the slides which carry the pivot rods such that the elements are spaced a distance one from the other corresponding to the length of the form to be stacked. As the paper on the tray engages the depending toe rollers of the elements, the elements are pivoted into a first position with the support surfaces thereof extending generally horizontally and resting on the top sheet of paper on the elevator tray, the next sheet of paper to be stacked extending upward through the opening between the elements.

As paper is pulled into the stacker by a puller roller mechanism, the paper is stacked on the horizontal surfaces of the elements between the vertical guides of the elements and on top of the rollers at the toe ends of the elements. The rollers support the paper adjacent to but inwardly spaced from the edges of the paper near the fan-folds, while the center of the form rests on paper already fed onto the elevator tray below the elements. It will be appreciated that paper will continue to stack between the elements above the horizontal surfaces and rollers of the elements.

Upon sensing a predetermined height of paper stacked on the elements, for example, a stack about one inch high, a signal is provided. For example, an infrared light beam may shine across the width of the stacker and may be interrupted by the top of the one-inch stack of paper accumulated on the elements. At that time, the elevator tray is lowered by a timed duration of power to the tray motor. As the tray lowers, the elements pivot outwardly away from one another and from the edge folds of the paper. This occurs as a result of the centers of gravity of the elements being inward of their pivotal axes during stacking and as a result of the weight of the paper exerted on the toe rollers which, during stacking, is likewise inward of the pivot axes. Thus, the combined effect of lowering the elevator tray (hence removing the support which maintains the elements in their first position) and permitting the elements to pivot away from one another and the folds, causes the paper accumulated on the elements to drop past the elements onto the stack of paper accumulated on the elevator tray.

When tray lowering times out, the tray is raised. As the top of the accumulated stack on the tray reaches the elements, it engages the toe rollers. Upon further upward movement of the tray, the elements pivot inwards as the rollers roll toward the middle of the stack. Inward pivoting of the elements ceases when the bottom surfaces of the elements lie flat against the top of the stack of paper accumulated on the tray. Upward tray motion, however, continues to drive the elements upwardly against the bias of the springs at their pivot points. Thus, the paper accumulated on the tray is compressed between the tray and the bottom surfaces of the elements. When the top of the compressed paper stack blocks an infrared light beam and before the elements reach their mechanical limit of vertical travel, the tray is moved downwardly away from the elements by a timed duration of power to the tray motor. The tray thus moves to a lowered position and in which position the accumulated paper on the tray remains engaged with the rollers to maintain the support surfaces of the elements in their generally horizontal paper supporting first position. This enables another predetermined height of paper to be stacked on the elements whereupon the cycle is repeated until the paper supply has been completely stacked.

Accordingly, in one aspect of the present invention, there is provided apparatus for stacking fan-folded paper forms, comprising a frame, a form support tray carried by the frame, at least one form support element carried by the frame disposed above the form support tray for receiving forms to be stacked and means mounting the form support element on the frame for movement between a first position for supporting a plurality of fan-folded forms and a position for releasing the fan-folded forms for delivery onto and support by the tray.

In a still further aspect of the present invention, there is provided a method of stacking fan-folded forms exiting a printer comprising the steps of supporting a plurality of fan-folded forms above a support tray adjacent the printer exit and releasing the plurality of fan-folded forms above the support tray for delivery onto and support by the support tray.

Accordingly, it is a primary object of the present invention to provide novel and improved apparatus and methods for stacking fan-folded paper forms in a manner which, among other objectives, will reliably maintain the top of the accumulated paper stack flat by repeated compressions of the accumulated paper stack on the tray thereby minimizing or eliminating stacking failures resultant from uneven surfaces at the top of the accumulated stack.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
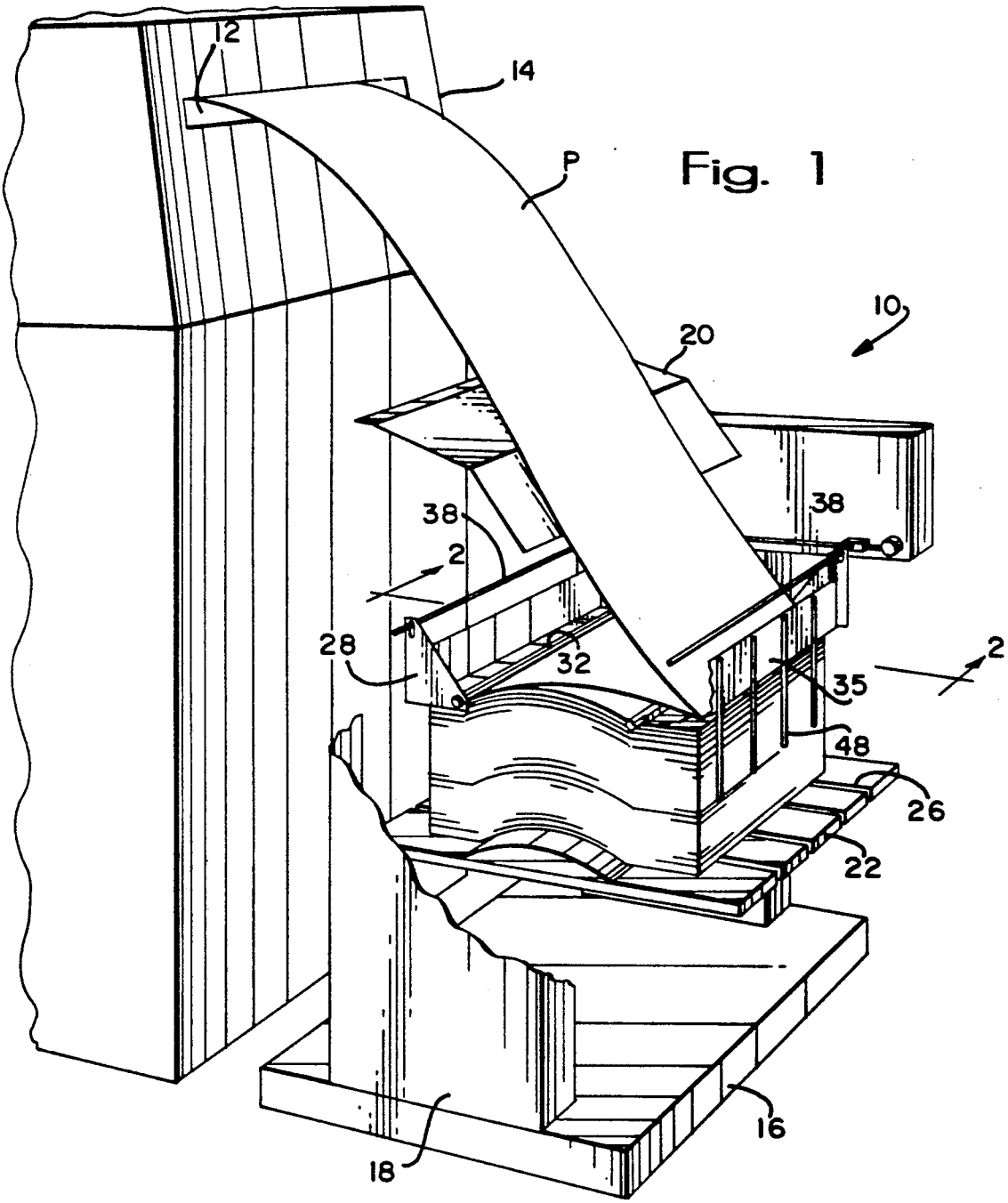
FIG. 1 is a fragmentary perspective view with parts broken out for ease of illustration showing a continuous paper form exiting a printer and being stacked by a stacker according to the present invention.
Figure 1A:
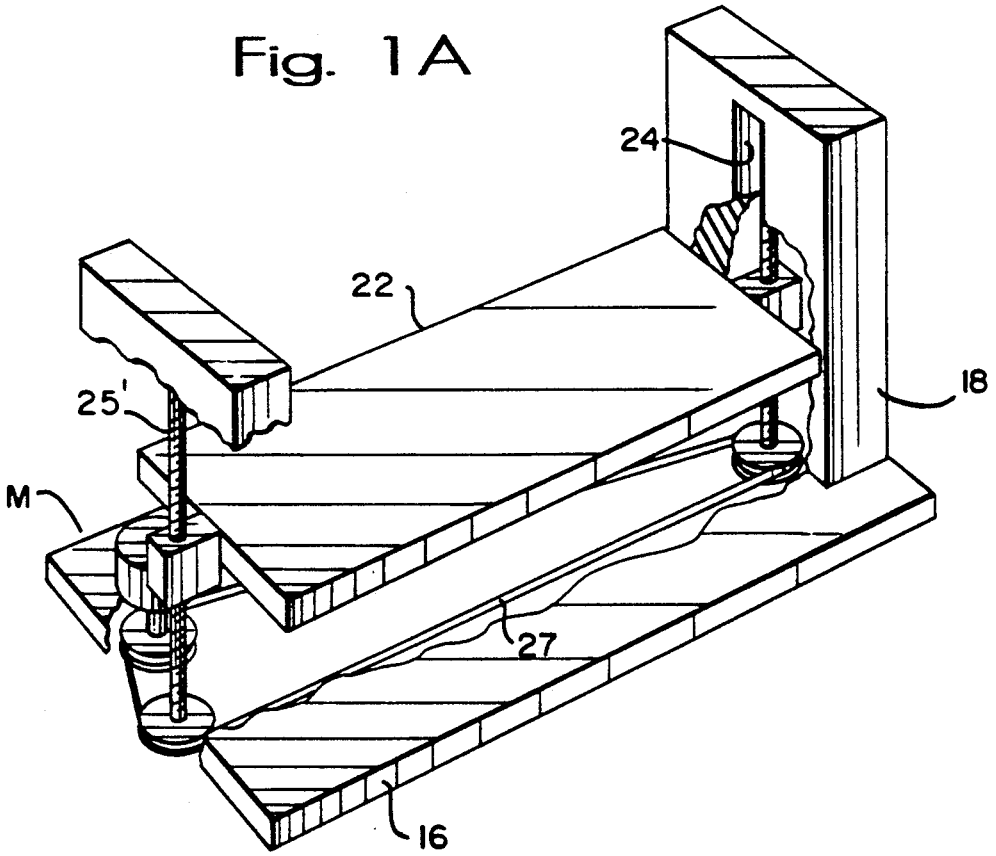
FIG. 1A is a fragmentary perspective view of the drive for the tray of the stacker of the present invention.

Referring now to the drawings, particularly to FIG. 1, there is illustrated a paper stacker constructed in accordance with the present invention and generally designated 10. In FIG. 1, paper P is illustrated issuing from an exit opening 12 of a printer 14, for example, a printer of the type which may have a printing speed of up to 2,000 lines per minute. It will be appreciated, however, that paper stacker 10 may be used with any printer where it is desired to stack fan-folded paper, irrespective of variations in the speed of the printer and, more generally, may be used in any environment where stacking fan-folded paper is desired. Paper P is conventionally perforated or scored along transversely extending lines such that the paper can be fan-folded, i.e., into continuous Z configurations.

Figure 2:
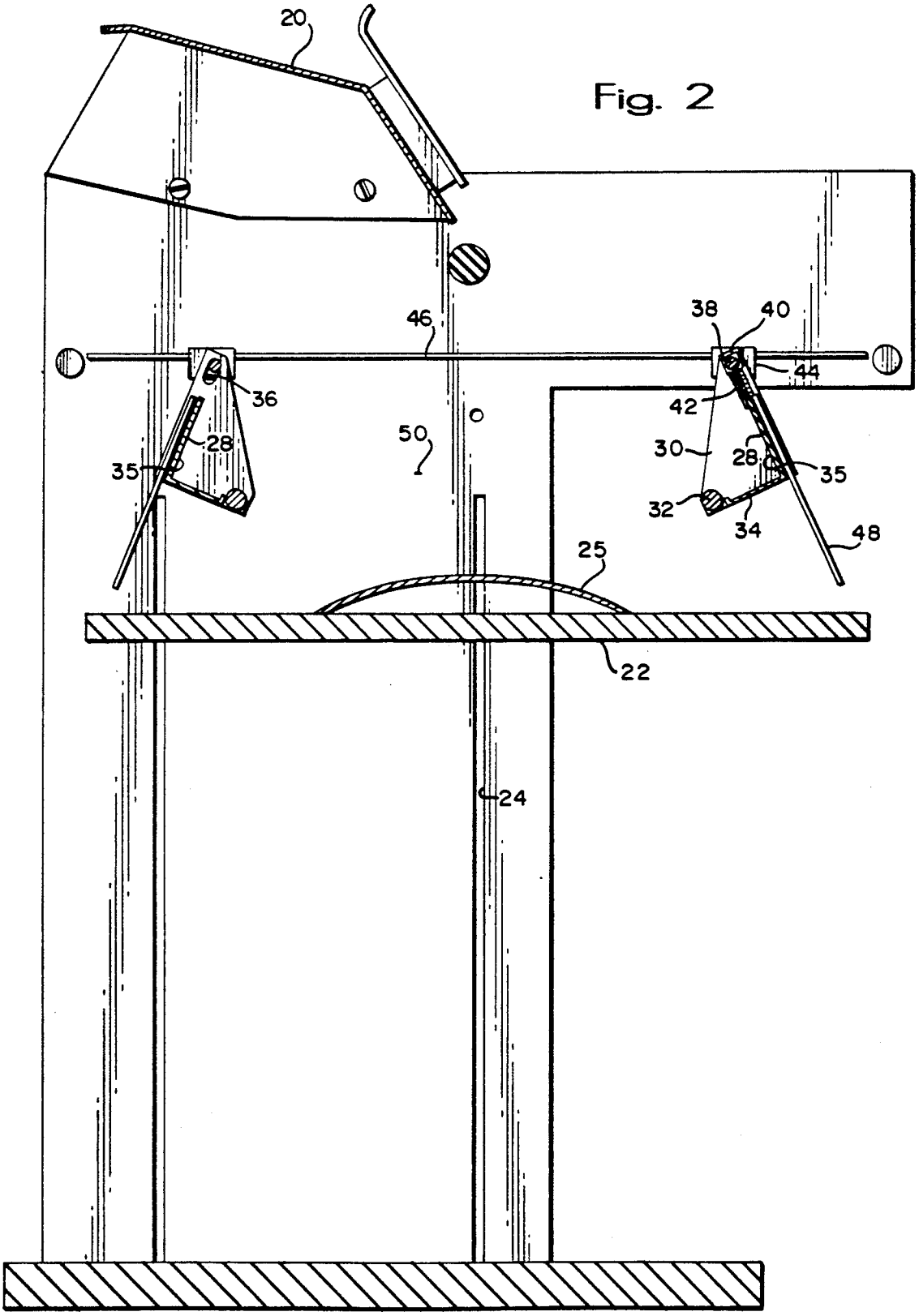
FIG. 2 is an enlarged vertical cross-sectional view thereof taken generally about on lines 2—2 in FIG. 1.

As best illustrated in FIGS. 1 and 2, paper stacker 10 comprises a base 16 and a pair of laterally spaced side frames 18 upstanding from base 16. It will be appreciated that a series of guides 20 may be interposed between opposite side frames 18 adjacent the top of stacker 10 to guide paper P into stacker 10. Stacker 10 also includes a tray 22 which is operated by a motor M, for raising and lowering movement relative to base 16. For example, the tray 22 may be driven through and guided by guide slots 24 housing lead screws 25 driven by a belt 27 connected to motor M to effect raising and lowering motion. Tray 22 is provided with an arcuate central section extending its full width which imparts an upwardly directed hump in the paper stack on tray 22. A plurality of longitudinally extending slots 26 are provided in tray 22 for purposes described hereinafter.

A pair of oppositely disposed channels or elements are provided, each preferably comprising a generally L-shaped element 28, closed at opposite ends by generally triangularly-shaped end plates 30. Each element 28 includes a roller 32 mounted for free-rolling movement at the toe or inner end of the generally horizontally disposed leg 34 of element 28 and between the end plates 30. Each element includes a generally vertically extending guide leg 35. As best illustrated by the lefthand element 28 shown in FIG. 2, the upper end of each end plate 30 is provided with a vertically extending slot 36 into mounting the element 28. A bearing block 40 is suitably disposed about each rod 38 and a spring 42 interconnects between block 40 and a tab or lug, not shown, carried by the vertically extending guide leg 35. Spring 42 is illustrated on the righthand element 28 in FIG. 2. It will be appreciated, however, that the spring is applied between each end plate 30 and the corresponding rod 38, the lefthand element in FIG. 2 being illustrated without the spring only for purposes of showing the slot 36 and rod 38 in slot 36.

With this construction, upward movement of elements 28 is permitted by sliding the end plates vertically relative to rods 38 against the bias of springs 42. Thus, elements 28 are movable vertically upwardly against the bias of springs 42 a distance limited by the extents of the slots 36. Rods 38 are disposed in slides 44 mounted on tracks 46 which extend lengthwise of each frame 18. The slides 44 thus permit the elements 28 to slide toward and away from one another into selected adjusted positions depending upon the length of each of the forms being folded. The slides preferably have clamping mechanisms which lock the slides in selected adjusted positions along tracks 46. Additionally, for reasons which will become apparent, paper guide rods 48 depend from the vertical guide leg 35 of each element in longitudinally spaced positions therealong and lie in registry with the slots 26 in tray 22.

The elements 28 are configured such that the center of gravity of each element lies inwardly of the pivot axis of the element about rod 38. Thus, without any weight or other external forces applied to the elements 28, the elements 28 will depend from rods 38 freely with the lower leg 34 in an inclined position. This inclined position tends to open the spacing 50 between the rollers 32 of elements 28. Thus, before any paper is supplied to the stacker or supplied to the elements 28 as set forth in the ensuing description of a preferred method of operation of stacker 10, elements 28 will be inclined or canted for the horizontal, for example, as illustrated in FIG. 3*a*.

Figure 3C:
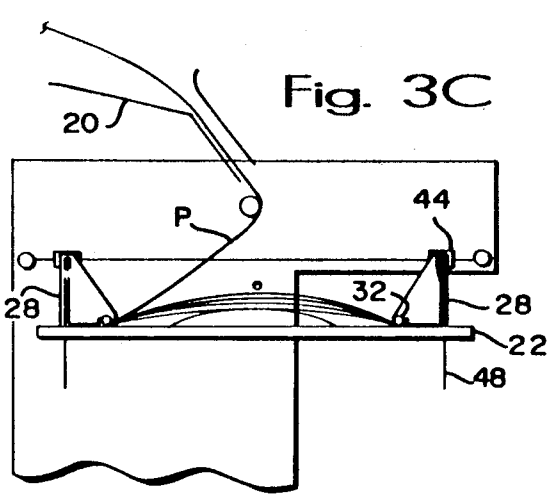
FIGS. 3A–3H and 3J–3K are views similar to FIG. 2 on a reduced scale illustrating a sequence of stacking steps according to the present invention, FIG. 3I being a view similar to FIG. 3H on an enlarged scale.
Figure 3B:
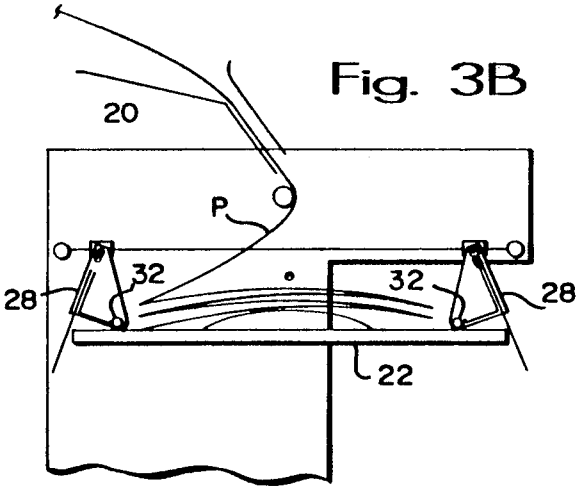
Figure 3A:
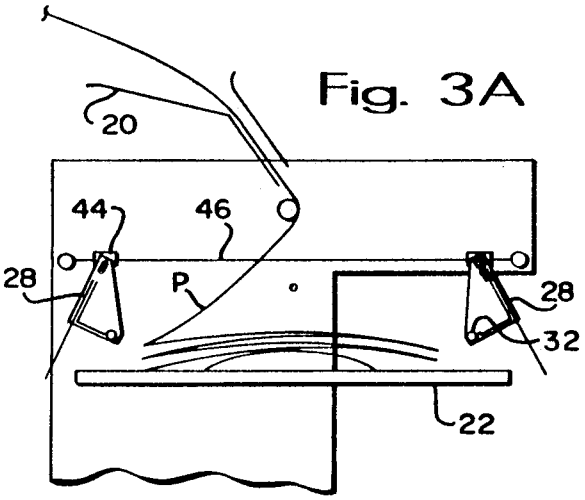
Figure 3F:
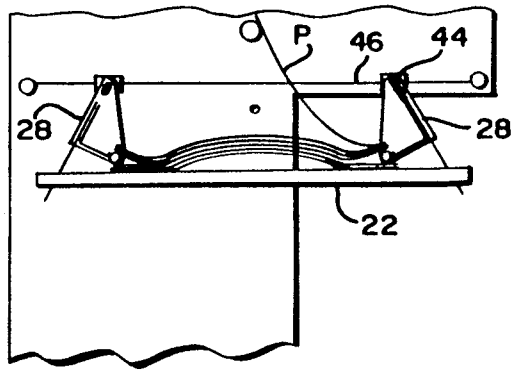
Figure 3E:
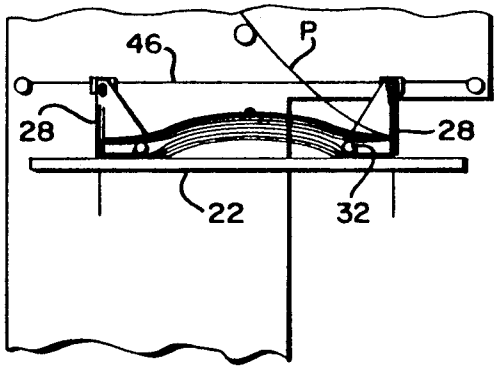
Figure 3D:
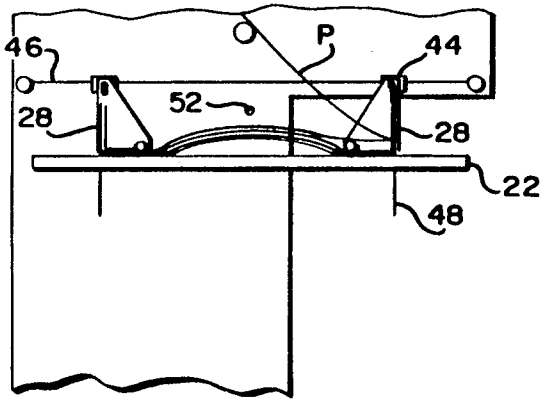
Figure 3I:
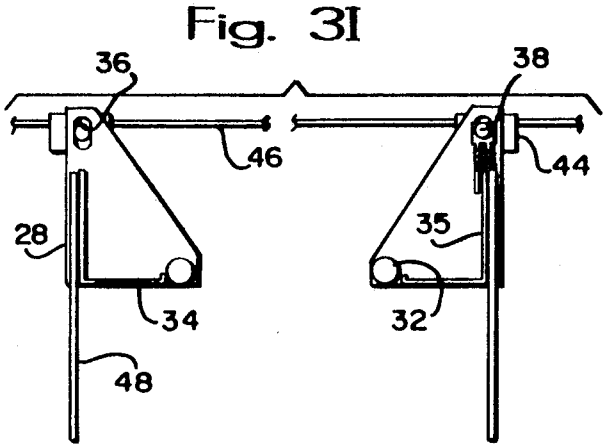

Referring now to FIGS. 3A–3K, the operation of stacker 10 will now be described. In FIG. 3A, stacker 10 is illustrated with elements 28 freely depending in their inclined positions from support rods 38. Tray 22 has been elevated by operation of the motor, not shown, into an upper position and a few forms of paper P are illustrated stacked on tray 22 in a continuous fan-folded configuration in a manner which is conventional. Note that elements 28 are spaced one from the other a distance greater than the length of the forms being folded. Further upward movement of tray 22 causes engagement of the tray with rollers 32 as illustrated in FIG. 3B. Continued further upward movement of tray 22 causes elements 28 to pivot inwardly such that lower legs 34 assume generally horizontal positions as in FIG. 3C. Just prior to obtaining those positions, the elements 28 are moved toward one another by moving the slides 44 which carry rods 38 along tracks 46, a distance corresponding to the length of each form to be stacked. When moving the slides, rollers 32 overlie the edge portions of the stacked fan-folded paper on tray 22 as illustrated in FIG. 3D. Thus, with the elements 28 suitably spaced one from the other a distance corresponding to the length of each form, further deposition of the paper on the stacker causes the forms to fan-fold in stacking relation on top of the support legs or surfaces 34 and rollers 32 of elements 28 as illustrated in FIG. 3E. The upright guide surfaces 35 maintain the stacked forms between elements 28.

Figure 3H:
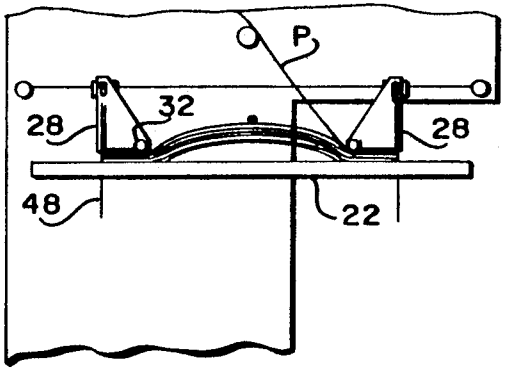
Figure 3K:
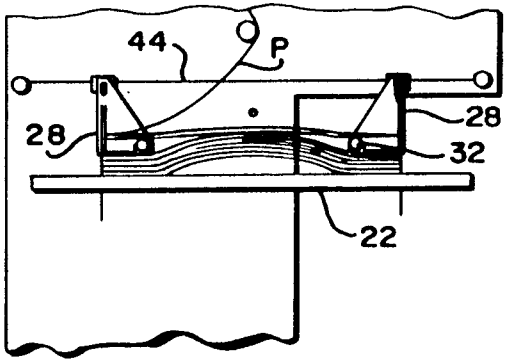
Figure 3G:
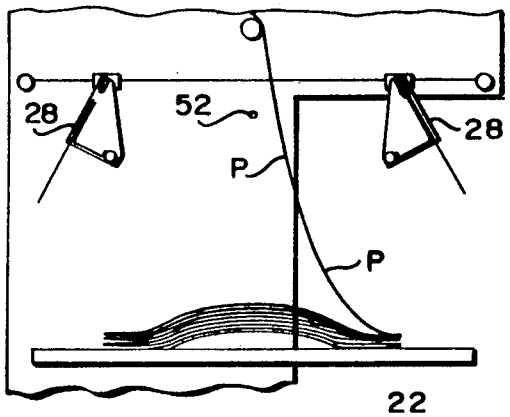

When a suitable quantity of forms are stacked on elements 28, for example, to a height of about one inch, the height of the stacked paper on elements 28 is sensed by a sensor 52, for example, an infrared beam, which causes the tray motor to lower tray 22 from below elements 28. As tray 22 is lowered, the weight of the forms stacked on elements 28 in conjunction with the natural tendency of elements 28 to pivot outwardly away from one another to achieve their freely depending positions from rods 38, permits elements 28 to pivot away from one another as illustrated in FIG. 3F. This enables the forms stacked on elements 28 to fall through the opening 50 between the elements onto the forms previously stacked on tray 22 as illustrated in FIG. 3F and 3G. That is, the outward pivoting of elements 28 is a result both of the center of gravity of each element being inward of its pivotal axis during stacking and the forces exerted by the weight of the paper on the toe rollers 32, also inward of the pivot axes and hence they constitute means responsive to movement of the tray away from the elements 28 to pivot passively the elements 28 away from the first support position to the release position.

Figure 3J:
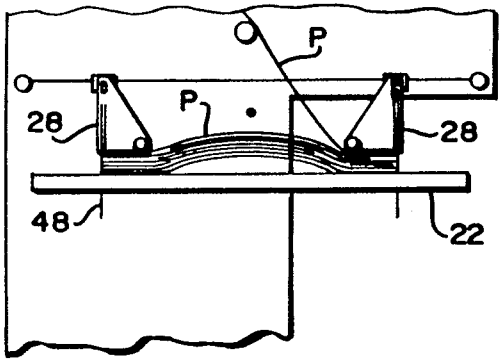

When the downward movement of the tray times out, the tray is raised into a position where the top of the paper accumulated on tray 22 engages the toe rollers 32. Upon such engagement, elements 28 pivot inwardly toward one another such that the lower legs 34 are pivoted into a generally horizontal paper support surface orientation as illustrated in FIG. 3H. Further upward movement of tray 22 causes the elements 28 to jointly move upwardly against the bias of springs 42. That is, the slots 36 of end plates 30 of elements 28 enable elements 28 to move upwardly relative to the rods 38 and against the bias of springs 42. This is illustrated in the enlarged drawing FIG. 3I. This causes the lower legs 34 of elements 28 to compress the accumulated paper stack on tray 22. When the top of the paper stack on tray 22 blocks sensor 52, the upward movement of the tray is reversed. The tray then moves downwardly away from elements 28 a predetermined distance, for example, about one inch by a timed duration of the power applied to the tray motor. This is illustrated in FIG. 3J. It will be appreciated, however, that rollers 32 and the legs 34 remain in contact with the accumulated paper stack on tray 22 and the underlying paper stack maintains the elements 28 in the positions illustrated in FIG. 3J whereby additional paper may be stacked on the elements 28. When the paper is stacked on elements 28 to a predetermined height, the paper stacking cycle repeats. Thus, after a predetermined accumulation on elements 28, the tray is lowered to release the paper accumulated on elements 28, dropping it down onto the top of the paper previously accumulated on tray 22. Thereafter, tray 22 moves upwardly to compress the accumulated paper stack against elements 28. After compression, the tray is moved downwardly a predetermined distance, where additional paper is stacked on elements 28. The cycle is thus successively repeated until the complete supply of paper has been stacked.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for fanfold stacking paper forms, comprising:

a frame;

a form support tray carried by said frame;

at least one form support element carried by said frame disposed above said form support tray for receiving forms to be stacked;

means mounting said form support element on said frame for pivotal movement about a pivot between a first position for supporting a plurality of fan-folded forms and a position for releasing the fan-folded forms for delivery onto and support by said tray;

means for biasing said support element for pivotal movement from said first position toward said release position; and means carried by said frame for moving said tray toward said support element to engage the fanfolded forms accumulated on said tray against said element to maintain said element in said first pivotal position thereof against the bias of said biasing means.

2. Apparatus according to claim 1 including a second form support element carried by said frame disposed above said form support tray for receiving forms thereon, said support elements being spaced laterally one from the other to define an opening therebetween and means mounting said second form support element on said frame for pivotal movement about a pivot between a first position for supporting a plurality of fanfolded forms and a position for releasing the fanfolded forms for delivery onto and support by said tray, said release positions of said elements being such that the fanfolded forms are delivered through said opening onto said tray, means for biasing said second form support element for pivotal movement from said first position toward said release position, and means carried by said frame for moving said tray toward said support elements to engage the fanfolded forms accumulated on said tray against said elements to maintain said elements in said first pivotal positions thereof against the bias of said biasing means.

3. Apparatus according to claim 1 including means for sensing a predetermined quantity of said plurality of fanfolded forms on said support element and means responsive to said sensing means for moving said tray away from said support element enabling said support element to respond to said biasing means and move from said first position into said release position thereby releasing said predetermined quantity of said plurality of fanfolded forms from said element onto said tray.

4. Apparatus according to claim 2 wherein said sensing means senses the height of the predetermined quantity of said plurality of fanfolded forms on said support element.

5. Apparatus for fanfold stacking paper forms, comprising:

a frame;

a form support tray carried by said frame;

at least one form support element carried by said frame disposed above said form support tray for receiving forms to be stacked;

means mounting said form support element on said frame for pivotal movement between a first position for supporting a plurality of fanfolded forms and a position for releasing the fanfolded forms for delivery onto and support by said tray;

means carried by said frame for moving said tray away from said element, said element having a generally horizontal fanfolded form support surface in said first position thereof; and means responsive to movement of said tray away from said element enabling said element to pivot passively under the weight of the plurality of fanfolded forms supported thereby from said first position toward said release position, said responsive means including a center of gravity of said element spaced from said pivot such that said element obtains a position with said horizontal form support surface inclined to the horizontal when supported freely at said pivot.

6. Apparatus according to claim 5 including means carried by said tray for moving said tray toward said support element to engage the fanfolded forms accumulated on said tray against said element to maintain said element in said first pivotal position thereof.

7. Apparatus according to claim 5 wherein said element includes a generally horizontal fanfolded form support surface in said first position thereof and means disposed adjacent an edge of said support surface including a roller inwardly of the edge folds of the fanfolded form for supporting said forms intermediate the edge folds thereof.

8. Apparatus according to claim 5 including means mounting said element for movement in a generally vertical direction and means carried by said frame for moving said tray toward said support element to engage the fanfolded forms accumulated on said tray against said element and move said element in a generally vertical direction in response thereto whereby the forms carried by said tray are compressed.

9. Apparatus according to claim 5 including a second form support element carried by said frame disposed above said form support tray for receiving forms thereon, said support elements being spaced laterally one from the other to define an opening therebetween and means mounting said second form support element on said frame for pivotal movement about a pivot between a first position for supporting a plurality of fanfolded forms and a position for releasing the fanfolded forms for delivery onto and support by said tray, said release positions of said elements being such that the fanfolded forms are delivered through said opening onto said tray, said second form support element having a generally horizontal fanfolded form support surface in said first position thereof, and means responsive to movement of said tray away from said elements enabling said second form support element to pivot passively under the weight of the fanfolded forms supported thereby from said first position toward said release position, aid responsive means including a center of gravity of said second form support element spaced from said pivot thereof such that said second form support element obtains a position with said horizontal form support surface thereof inclined to the horizontal when supported freely at said pivot.

10. Apparatus according to claim 9 including means carried by said frame for moving said tray toward said support elements to compress the fanfolded forms accumulated on said tray against said elements.

11. Apparatus according to claim 9 including means carried by said frame for moving said tray toward said support elements to engage the fanfolded forms accumulated on said tray against said elements and maintain said elements in said first pivotal positions thereof.

12. Apparatus according to claim 5 including means for sensing a predetermined quantity of said plurality of fanfolded forms on said support element and said tray moving means being responsive to said sensing means for moving said tray away from said element enabling said element to pivot passively from said first position into said release position.

13. A method for fanfold stacking of forms exiting a printer comprising the steps of:

providing a pair of pivoted support elements on opposite sides of the forms exiting the printer;

maintaining the elements in first pivotal positions;

supporting a plurality of fanfolded forms above the support tray on said pivotal support elements in said first pivotal position thereof;

pivoting said elements from said first positions into positions for releasing the plurality of fanfolded forms supported thereby for delivery to a support tray;

releasing the plurality of fanfolded forms above the support tray from said elements when in said release positions for delivery onto and support by the support tray; and supporting the released fanfolded forms on said support tray.

14. A method according to claim 13 including the step of compressing a plurality of fanfolded forms supported on the tray against said support elements to maintain said elements in said first pivotal positions.

15. A method according to claim 13 including the step of displacing said support tray to engage paper supported thereby against said support elements to displace said support elements from said release positions into aid first positions for supporting the plurality of fanfolded forms.

16. A method according to claim 13 including the step of engaging the fanfolded forms on the support tray against said pivoted support elements to maintain said pivotal support elements in said first positions thereof.

17. A method according to claim 13 including the step of providing a freely pivotal pair of support elements, the step of pivoting said support elements including locating the center of gravity thereof such that said support elements are biased for pivotal movement toward said release positions, and the step of pivoting the support elements from said first positions into said release positions being passive and responsive to the weight of said plurality of fanfolded forms and the bias of said elements toward said release positions.

18. A method according to claim 17 wherein the step of pivoting is in response to the weight of the fanfolded forms on said element.

19. A method according to claim 13 including displacing the support tray away from said elements, the step of pivoting said elements being in response to displacing the support tray away from said elements.

20. A method according to claim 19 wherein the step of pivoting the support elements from said first position to said release position is passive.

* * * * *